US006335591B1

(12) United States Patent
Hirao et al.

(10) Patent No.: US 6,335,591 B1
(45) Date of Patent: Jan. 1, 2002

(54) LUMINESCENCE DISPLAY PANEL USING DISCHARGE GAS

(75) Inventors: Kazunori Hirao, Yao; Koji Aoto, Moriguchi; Yoshihito Tahara, Ibaraki, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/250,177

(22) Filed: Feb. 16, 1999

(30) Foreign Application Priority Data

Feb. 18, 1998 (JP) ..... 10-036275

(51) Int. Cl.[7] ..... H01J 1/62
(52) U.S. Cl. ..... 313/484; 313/493
(58) Field of Search ..... 313/484, 489, 313/493, 111, 112

(56) References Cited

U.S. PATENT DOCUMENTS

| | | | | |
|---|---|---|---|---|
| 3,619,698 A | | 11/1971 | Caras | 313/210 |
| 4,224,553 A | * | 9/1980 | Hellwig | 313/489 |
| 4,626,071 A | * | 12/1986 | Wada et al. | 350/311 |
| 4,692,662 A | * | 9/1987 | Wada et al. | 313/493 |
| 4,989,953 A | * | 2/1991 | Kirschner | 350/311 |

FOREIGN PATENT DOCUMENTS

| | | | | |
|---|---|---|---|---|
| EP | 0 580 868 | 2/1994 | | |
| EP | 0 782 166 | 7/1997 | | |
| JP | 4-58436 | 2/1992 | | |
| JP | 5-121002 | 5/1993 | | |
| JP | 5-314913 | 11/1993 | | |
| JP | 10269950 | * 9/1998 | | 313/489 |
| JP | 10-269950 | 10/1998 | | |

OTHER PUBLICATIONS

Patent Abstracts of Japan, vol. 099, No. 001, Jan. 29, 1999 & JP 10 269950 A (Matsushita Electric Ind. Co. Ltd.), Oct. 9, 1998 * abstract *.

Patent Abstracts of Japan, vol. 018, No. 116 (E–1515), Feb. 24, 1994 & JP 05 314913 A (NEC Corp.), Nov. 26, 1993 * abstract *.

* cited by examiner

*Primary Examiner*—Nimeshkumar D. Patel
*Assistant Examiner*—Todd Reed Hopper
(74) *Attorney, Agent, or Firm*—Wenderoth, Lind & Ponack, L.L.P.

(57) ABSTRACT

A gas discharge display panel has front and rear plates. The plates are spaced apart from each other, thereby forming a chamber in which a discharge gas is contained. Also, both the front and rear plates are dark in color. Preferably, both the front and rear plates have a darkness of about 20% or more or a transparency of about 80% or less. This decreases halation of light, thereby preventing the mixing of colors. Also, the gas discharge display panel provides a high contrast and clear images to viewers.

15 Claims, 7 Drawing Sheets

LUMINESCENCE DISPLAY PANEL USING DISCHARGE GAS

FIELD OF THE INVENTION

The present invention relates to a luminescence display panel using discharge gas for use with television and computer systems, for example.

BACKGROUND OF THE INVENTION

FIG. 6 illustrates a conventional luminescence display panel using discharge gas, generally indicated by reference numeral 20, for use preferably with a plasma display system. The panel 20, including transparent front and rear plates, 21 and 22, spaced apart from each other, is depicted so that one surface 23 of the front plate, away from the rear plate 22, is oriented upward.

Also, FIG. 7 illustrates an enlarged partial schematic view of an AC plasma display panel, which is an example of such luminescent display panels. As shown, the panel 20 includes a discharge chamber 3 between the front and rear plates, 21 and 22. The other surface of the front plate 21, opposing the rear plate 22, supports a plurality of pairs of elongated scanning and maintaining electrodes, 6 and 7, extending in a parallel fashion. The electrodes, 6 and 7, are covered with a dielectric layer 4 and further with a protection layer 5, positioned away from the front plate 21. The rear plate 22 supports a plurality of elongated data electrodes 8 each extending perpendicular to the scanning and maintaining electrodes, 6 and 7, in a parallel fashion. Also supported on the rear plate 22 are a plurality of elongated partitions 9 each extending in parallel to and spaced a certain distance from the data electrodes 8, so that the discharge chamber 3 is formed between neighboring partitions 9. A phosphor 10 is provided between the neighboring partitions 9 so that it covers both data electrode 8 and opposing side surfaces of the partitions 9 in the discharge chamber 3. For clarity of the drawing, the phosphor 10 is illustrated only in part. Each discharge chamber 3 is filled with a gas mixture having xenon and at least one inert, as such as helium, neon, or argon.

In operation, an electric discharge is generated between the scanning and maintaining electrodes, 6 and 7, in the discharge chamber 3. This excites the phosphor 10 to emit visible light, which is used for displaying an image to be viewed on the front plate 21.

Referring to FIG. 8, which is a cross-sectional view taken along lines VIII—VIII in FIG. 7, descriptions will be made to the light emission. As shown, three neighboring phosphors 10 construct different color elements of each pixel, red light element 10R, green light element 10G and blue light element 10B for emitting red, green, and blue lights, respectively.

When the electric discharge 1 has occurred in the discharge chamber 3, the ultraviolet light 2 generated by the discharge 1 excites the phosphor 10. This allows the color elements 10R, 10G, and 10B to emit red, green, and blue light, respectively, as shown by dotted lines in FIG. 8. It should be understood that the light passes are provided by dotted lines in FIG. 8, as well as in other drawings, only for illustration.

FIG. 9, which is also a cross-sectional view taken along lines VIII—VIII in FIG. 7, illustrates passes of red light emitted only from the color element 10R. In this instance, the emitted red light RO and R1 passes through the front plate 21 and then projects out toward a viewer.

Simultaneously, the red light R1 projected obliquely to the front plate 21 is in part reflected at an inner surface 21*a* of the front plate 21 and then at the neighboring green element 10G. The reflected red light is then projected in part through the front plate 21, which is shown at R2. Remaining red light is reflected at the surface 21 a of the front plate 21 and then at the neighboring blue element 10B and, afterwards, projected through the front plate 21. Likewise, the light emitted obliquely is transmitted transversely and reflected on the green and blue elements, 10G and 10B, which results in an undesirable halation of the red light being projected through the front plate 21 to the viewer.

Also, the red light emitted from the back surface of the red element 10R is reflected at the inner surface of the rear plate 22 and then transmitted in part through the neighboring green element 10G, which is finally projected through the front plate 21 as shown at R4. Further, the red light reflected at the green element 10G is further reflected at the surfaces 22*b* and then 22*a* of the backing and then transmitted through the blue element 10B, which is finally projected through the front plate 21 as shown at R5. As such, another undesirable halation of the red light is projected through the front plate 21 to the viewer. This results in a degradation of a color contrast of the plasma display panel.

In addition, as shown in FIG. 10, which is also a cross-sectional view of taken along lines VIII—VIII in FIG. 7, when the red and green elements, 10R and 10G, simultaneously emit respective lights, the green lights GO and G1 are merged with the red light halation, R2 and R4, which degrades purity of the green color. At this moment, the red light is also merged with the green light, which also results in a degradation of the red color.

The halation can be evaluated. For example, as shown in FIG. 11A, in the evaluation, all the color elements on the left side of the AC plasma display panel are turned on to present a white image and, on the other hand, all the color elements on the right side are turned off to present a black image. Then, measured is a variation of brightness in a boundary zone between the left turned-on and right turned-off regions. When no halation is assumed to occur, the left side region ($L<0$) would provide 100% brightness in white and the right side region 0% brightness in black ($L>0$). Contrary to this, practically, as shown in FIG. 11B, although in the conventional AC plasma display 100% brightness is obtained in the left side turned-on region ($L<0$), the brightness in the right side turned-off region decreases gradually from the boundary line and then 0% brightness in black is obtained at a portion spaced a certain distance P away from the boundary line. Also, the distance P in which the brightness decreases from 100% to 0% is significantly large in the conventional AC plasma display panel. Therefore, the boundary line between the white and black regions is unclear due to the halation. This in turn deteriorates a color contrast purity of each color.

SUMMARY OF THE INVENTION

To overcome this problem, a luminescence display panel using discharge gas of the present invention includes dark front and rear plates. Preferably, darkness of each plate is equal to at least about 20%. Instead, transparency of each plate may be equal to at most about 80%. This allows the halation to be decreased considerably in the luminescence display panel of the present invention.

DETAILED DESCRIPTION OF THE PREFERRED EMBODIMENTS

Figure 1:
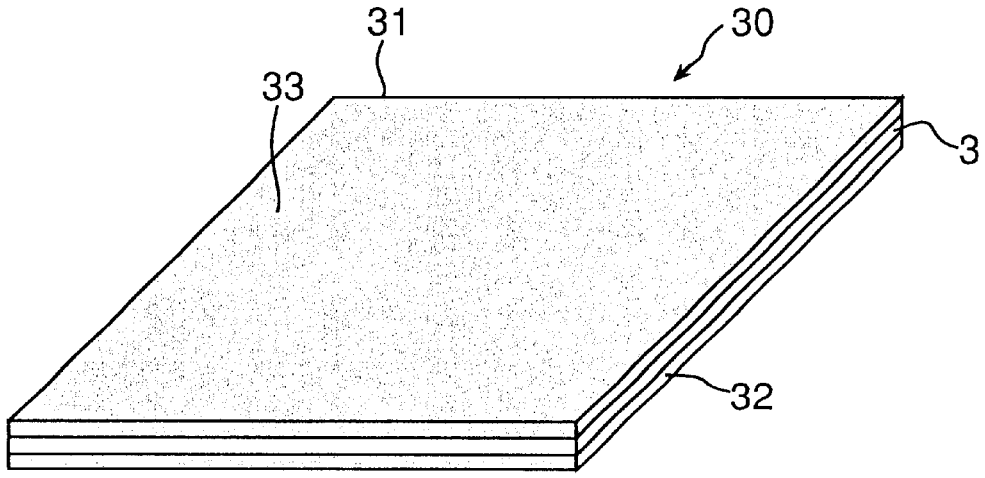
FIG. 1 is a perspective view of an embodiment of an AC plasma display panel according to the present invention.

Referring to FIG. 1, there is shown an AC plasma display panel, generally indicated by reference numeral 30, which is an embodiment of a luminescence display panel using discharge gas of the present invention. The AC plasma display panel 30 illustrated with its display surface 33 oriented upward includes a front plate 31 and a rear plate 32, both of which are in dark color. The plates, 31 and 32, are spaced apart from each other, forming a discharge chamber 3 between them. The AC plasma display panel 30 is similar to the above-described conventional AC plasma display panel 20 with an exception that the surface and rear plates, 31 and 32, have dark color. Therefore, in the following description, like reference numerals are provided for like elements and a detailed structural description of such elements is eliminated therefrom. Likewise, a physical structure of the display, except for darkness of the plates, is also identical to that described above and, therefore, no further description is made to this in the following description.

Figure 2:
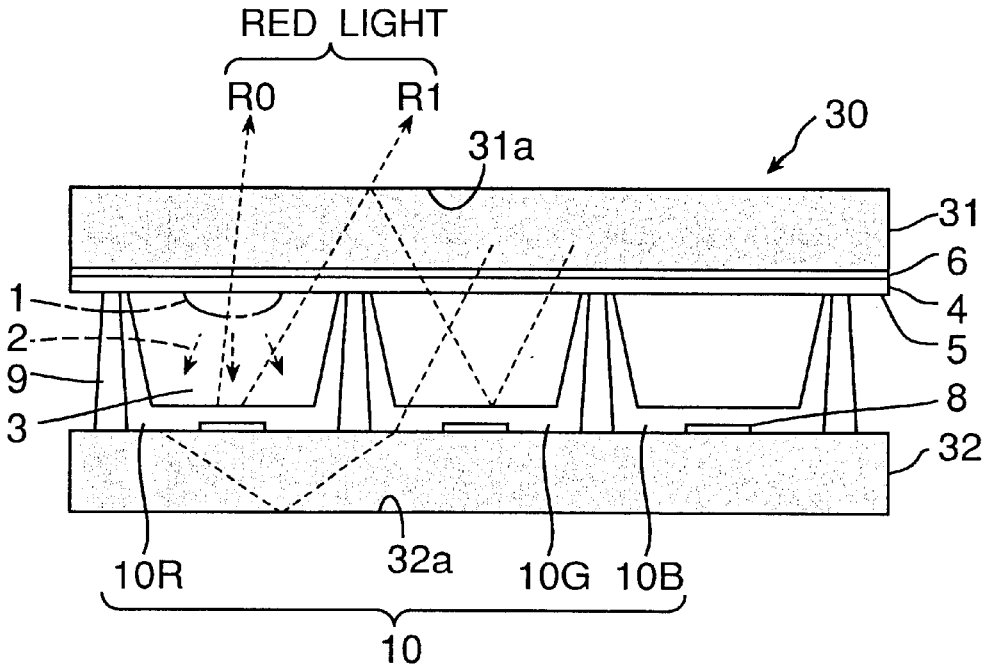
FIG. 2 is an enlarged cross-sectional view of the AC plasma display panel in FIG. 1, illustrating passes of light emitted from a red color luminescent element.
Figure 9:
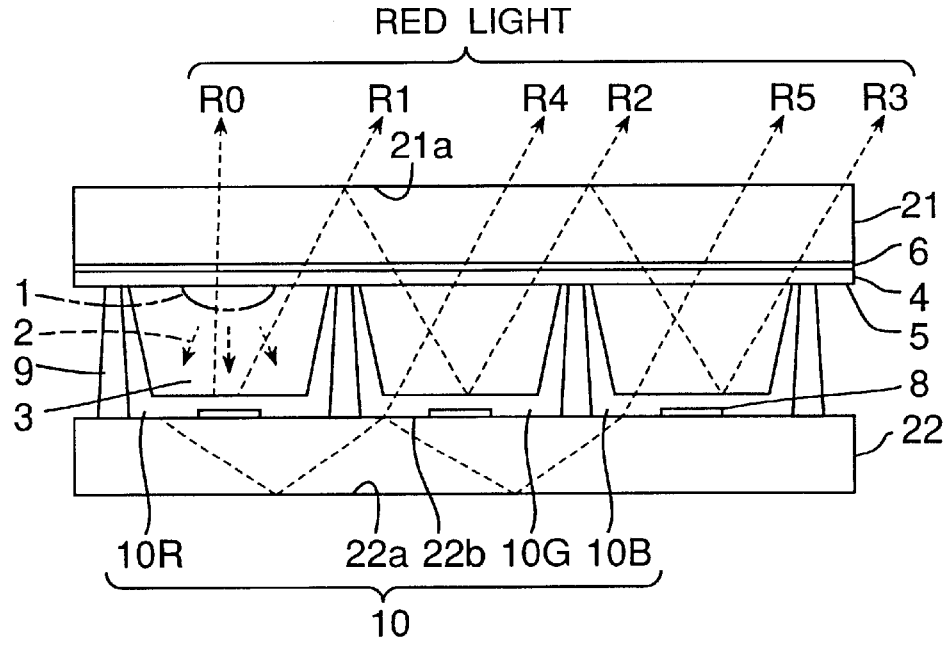
Fig.9 PRIOR ART
FIG. 9 is also a cross-sectional view taken along lines VIII—VIII in FIG. 7 in which only a red color element is energized to emit red light.
Figure 10:
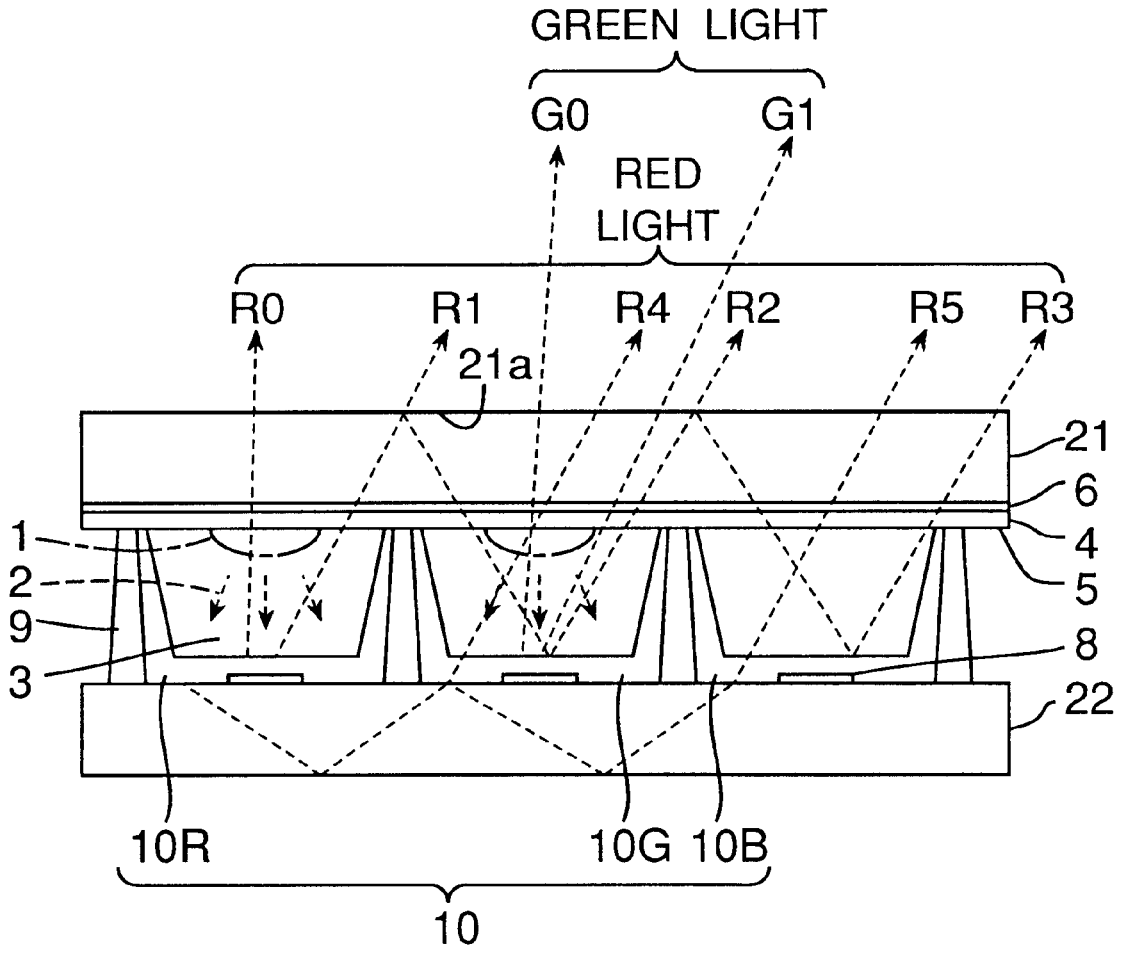
Fig.10 PRIOR ART
FIG. 10 is also a cross-sectional view taken along lines VIII—VIII in FIG. 7 in which red and green color elements are energized to emit red and green light, respectively.

FIG. 2, which is similar to FIG. 9 described above, is a cross-sectional view of the AC plasma display panel 30, illustrating light emitted only from a red luminescent element 10R. As shown, light R0 and R1 emitted form the red luminescent element 10R presents a fluorescence of red color to human beings. Most of the obliquely emitted light R0 is projected through the front plate 31, though; it is reflected in part at a surface portion 31 a of the front plate 31. The reflected light is then transmitted to a surface of a green element 10G. The transmitted light is considerably weak since it has been reduced considerably due to the darkness of the front plate 31. Then, the reduced light is reflected at the green element 10G and then transmitted to the front plate 31 again where it is further reduced considerably, allowing no or only a small part of the reduced light to pass through the front plate 31. Further, the reduced light may be reflected again at the front plate 31, then transmitted to a blue element 10B, and finally transmitted again to the front plate 31; however, the transmitted light is so weak that no light can be projected through the front plate 31.

Another red light emitted from the back surface of the red element 10R adjacent to the rear plate 32 is reflected at a surface 32*a* of the rear plate 32 and then transmitted to the green element 10G. In this instance, the light transmitted to the green element 10G has already been reduced much due to the darkness of the rear plate 32. In addition, the reduced light may be transmitted through the green element 10G and then to front plate 31 where it is again reduced considerably, allowing no or only a part of the reduced light to project through the front plate 31. Therefore, no reduced light will be transmitted to the neighboring blue element 10B. As such, when the red luminescent element 10R is energized, only red light such as R0 and R1 will be projected through the front plate 31, which ensures that no halation is generated due to the possible light reflection at the green and blue elements, 10G and 10B.

Figure 3:
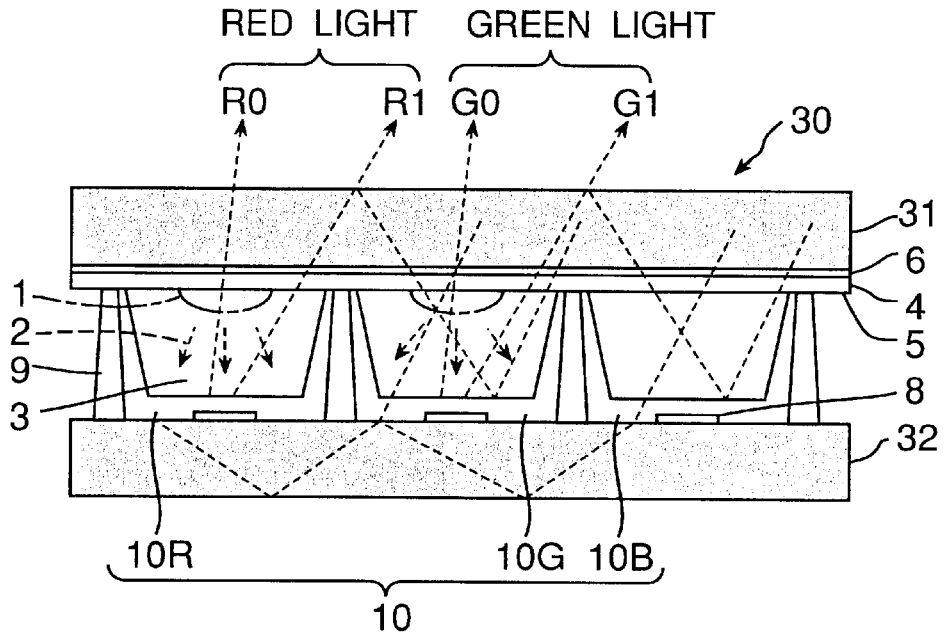
FIG. 3 is an enlarged cross-sectional view of the AC plasma display panel in FIG. 1, illustrating red and green light simultaneously emitted from red and green color luminescent elements, respectively.

As shown in FIG. 3, in the event that the red and green luminescent elements are energized at the same time, the light emitted from the green element 10G will induce no color mixing with the light emitted from the red element 10R, due to the darkness of the front and rear plates, 31 and 32, and thus results in considerable reduction of red light halation, which ensures the purity of the green color. Likewise, although not shown, no halation of green light is projected through the front plate 31, which prevents the green light from being mixed with the red light. This in turn ensures that the red light, R0 and R1, from the red element 10R is viewed clearly by the viewer without any color mixing.

Experiments were made to evaluate a halation using, an AC plasma display panel of 42 inches, having a resolution of 640 by 480 pixels, with each pixel having a size of 1.08 mm by 1.08 mm. Two plates were prepared for the front and rear plates, one plate P(d8-t92) having darkness of 8% (transparency of 92%) and the other plate P(d30-t7O) having darkness of 30% (transparency of 70%). As is known in the art, the darkness and transparency were defined by the following equations (1) and (2), respectively:

$$D=100\ (LT / LP)\ (\%) \quad (1)$$

D: Darkness

LT: Quantity of light transmitted through transparent glass plate

LP: Quantity of light projected from light source $$T=100-D\ (\%) \quad (2)$$

T: Transparency

Three display-panels were fabricated using the plates. Combinations of the plates are shown in the following table:

TABLE

Combination of Plates

| Plate Combination | Front plate | Rear plate |
|---|---|---|
| A | P(d8-t92) | P(d8-t92) |
| B | P(d30-t70) | P(d8-t92) |
| C | P(d30-t70) | P(d30-t70) |

Figures 11A, 11B:
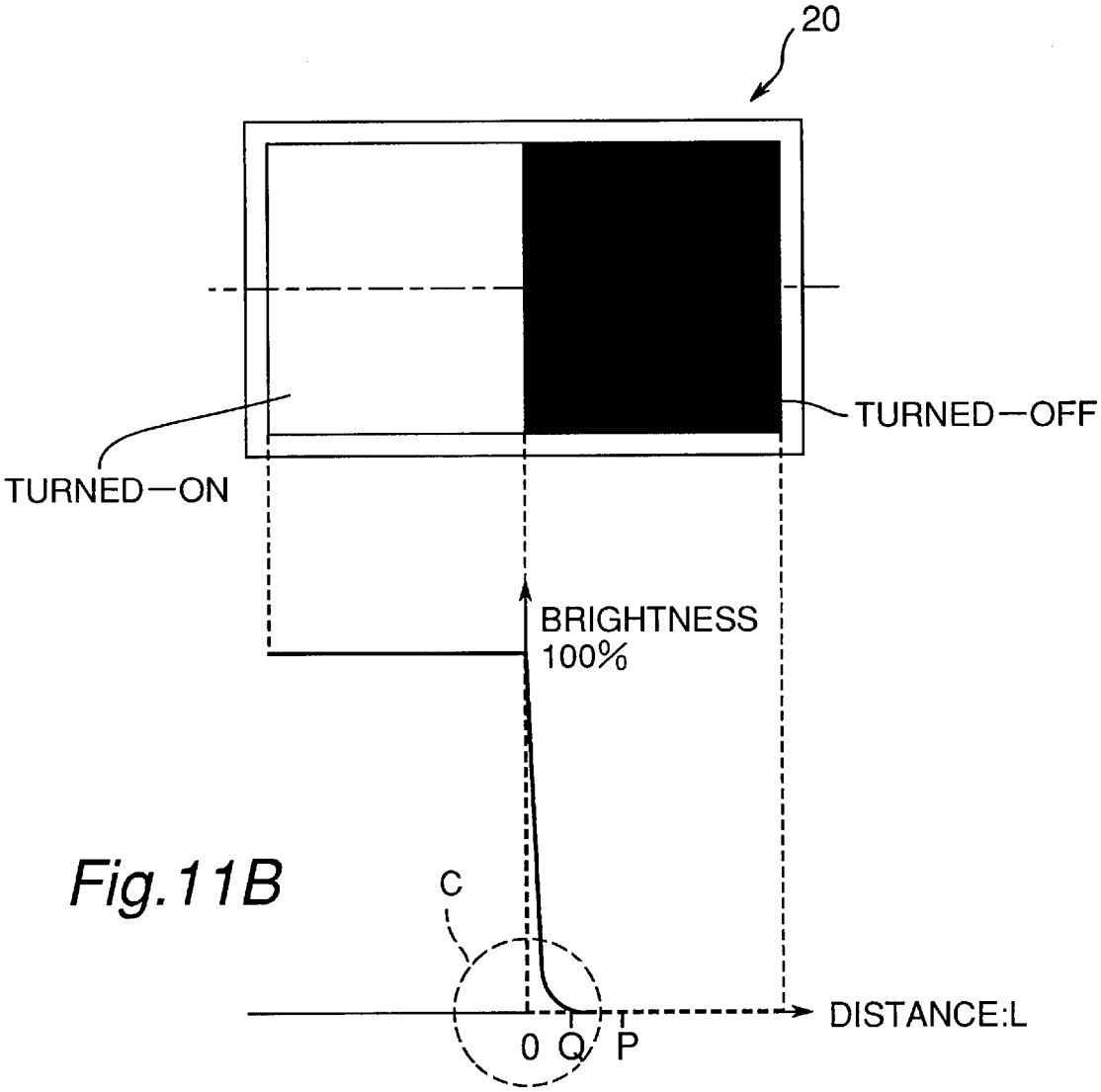
Fig.11A PRIOR ART
FIG. 11A is a front view of the plasma display panel in which a left side portion of the panel is turned on and a right side portion is turned off.
FIG. 11B is a graph showing a halation or a relationship of distance versus brightness in a boundary zone of left and right sides shown in FIG. 11A.

For each panel, as shown in FIG. 11A, the left side light elements were tuned on and the right side light elements were tuned off. In this state, a variation of the brightness was measured in the boundary zone indicated by a dotted-circle indicated at C in FIG. 11B.

Figure 4:
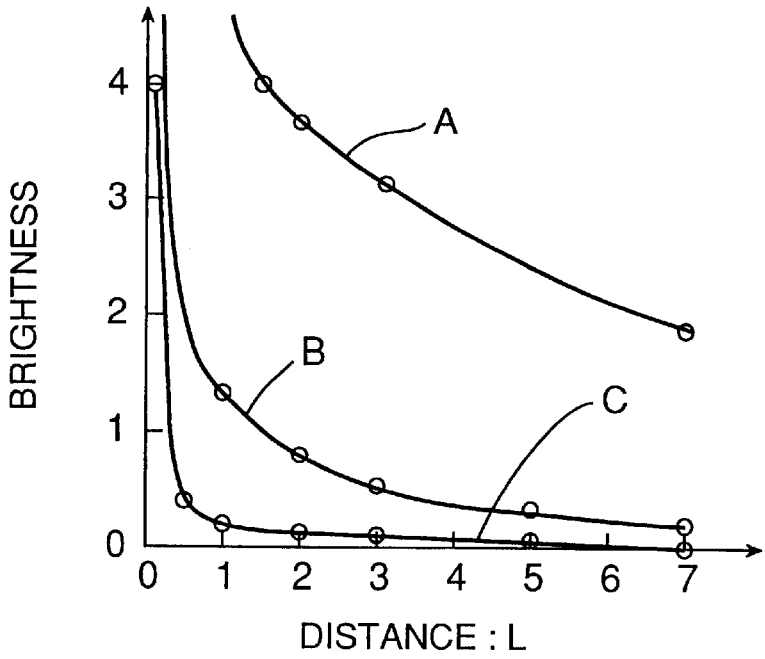
FIG. 4 is a graph illustrating a relationship of distance versus brightness for describing an effect of halation.

The test result is illustrated in FIG 4. This shows that the brightness decreases exponentially as the distance L increases, which means that the darkness is effective for reducing the adverse affect of the halation. Specifically, the plate combination A, in which the plate having the darkness of 8% (transparency of 92%) is used for both the front and rear plates, still presents much halation. In the plate combination B, halation is further decreased relative to the plate combination A but it is still strong. Contrary to this, the plate combination C decreases the halation considerably. This means that it is more effective for decreasing halation considerably to use plates having greater darkness for both the front and rear plates, than to use one plate having greater darkness for either of the front and rear plates and another plate having less darkness for the remaining plate.

Figure 5:
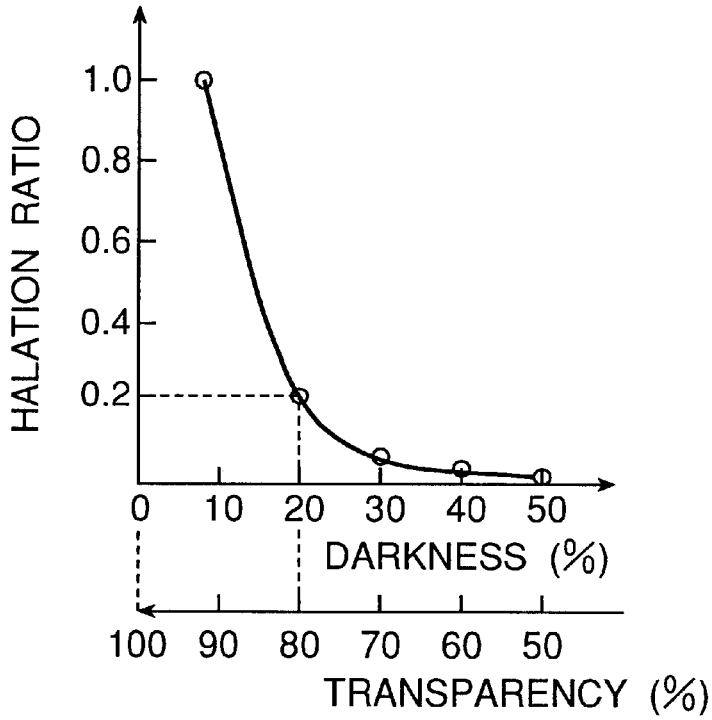
FIG. 5 is a graph illustrating a relationship of darkness or transparency versus halation ratio.
Figure 6:
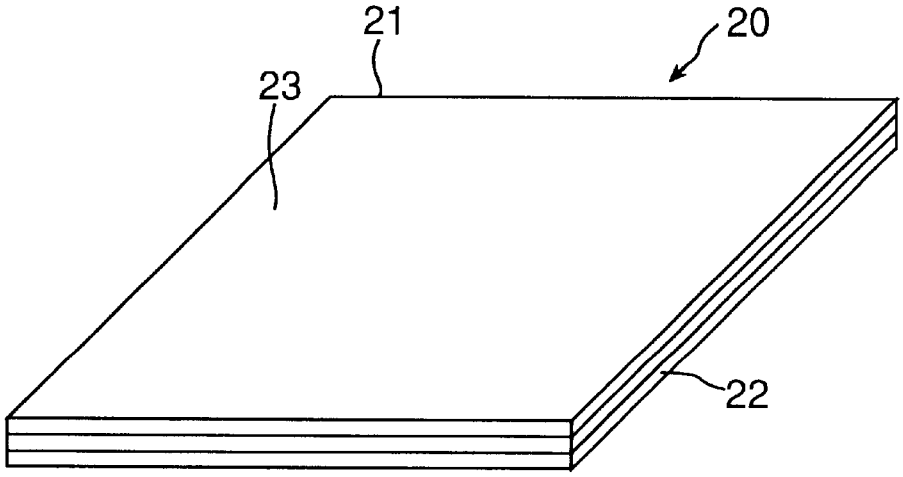
Fig.6 PRIOR ART
FIG. 6 is a perspective view of a conventional gas discharge display panel.
Figure 7:
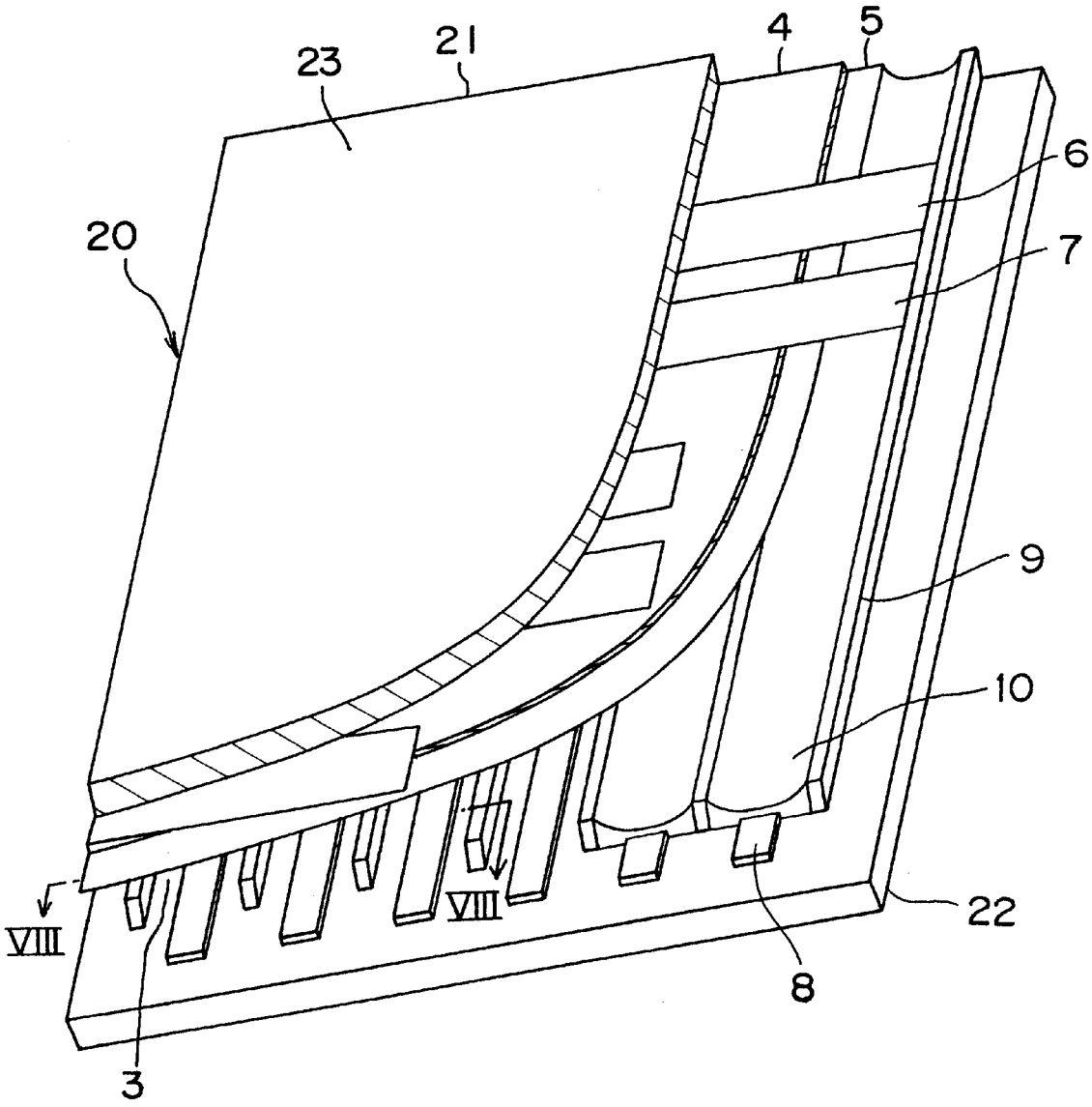
Fig. 7 PRIOR ART
FIG. 7 is a partial enlarged perspective view of a conventional AC plasma display panel.
Figure 8:
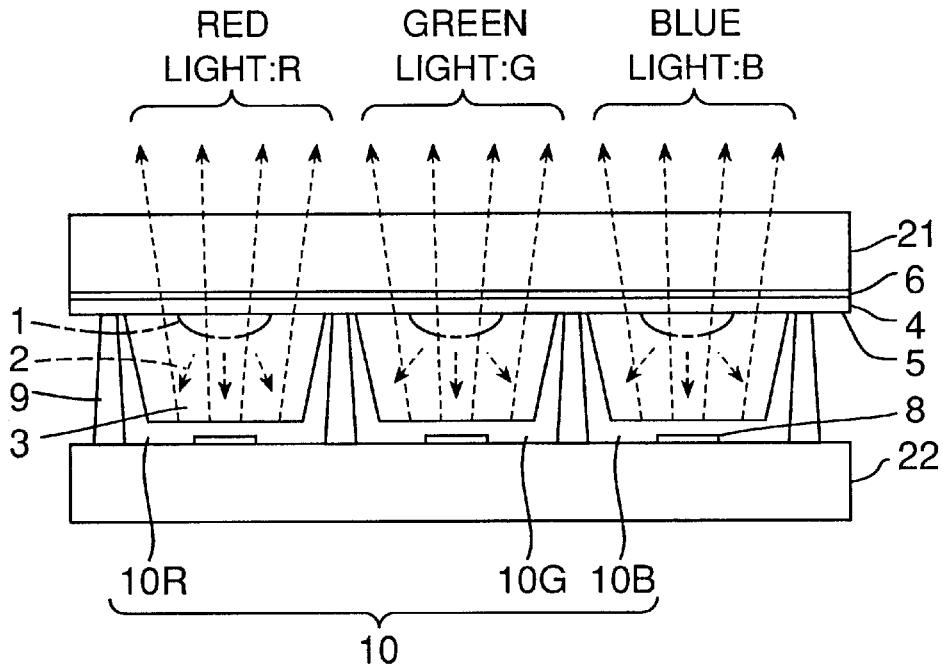
Fig.8 PRIOR ART
FIG. 8 is a cross-sectional view taken along lines VIII—VIII in FIG. 7 for illustrating a light emitting mechanism for display.

FIG. 5 shows the relationship between darkness (transparency) of the front and rear plates versus halation ratio. The halation ratio was defined by a ratio of brightness measured at a point indicated by Q in FIG. 11B, a certain distance away from the boundary line, relative to a reference brightness obtained at the same point in the plate combination A in which the plate having darkness of 8% (transparency of 92%) was used for both the front and rear plates. The result shows that, when the darkness (transparency) of both the front and rear plates was more than 20% (less than 80%), the halation ratio was 0.2 or less, in which condition no halation was recognized. This means that, by using a plate having darkness of more than 20% for both the front and rear plates, the halation is reduced so that the viewer will not recognize the halation. It should be noted that excessive increase in darkness of the plates, 31 and 32, will reduce brightness of the panel and therefore great care should be taken with respect to the brightness of the panel when deciding the darkness of the plates. It can be said that, in considering the brightness of the panel, the darkness of the front and rear plates should be less than about 60%.

Although in the previous experiments the suitable result was obtained when the front and rear plates have the same darkness of 30%, this is not restrictive to the present invention and the front and rear plates having different darknesses may be employed. It should be noted, however, using the same plate for both the front and rear plates is more economical in manufacturing the plates.

Although the description has been made to the AC plasma display panel 30, the present invention is not limited thereto and can be applied equally to other types of AC and DC plasma display panels. In this instance, the above-described advantages can be obtained to the same extent.

Accordingly, it is apparent from the above description that the present invention using darker front and rear plates decreases the halation considerably, and thereby prevents the mixing of color. This in turn allows the gas discharge display panel to provide a high contrast and clear images to viewers.

What is claimed is:

1. A gas discharge display panel, comprising:

a front plate; and a rear plate spaced from said front plate, such that a chamber is formed between said front plate and said rear plate, in which chamber a discharge gas is to be contained;

wherein said front plate and said rear plate are each dark in color.

2. The gas discharge display panel according to claim 1, wherein said front plate and said rear plate are each dark in color such that the darkness of each of said front plate and said rear plate is about at least 20%.

3. The gas discharge display panel according to claim 2, wherein said front plate and said rear plate are each dark in color such that the darkness of each of said front plate and said rear plate is about at least 20% and at most about at least 60%.

4. The gas discharge display panel according to claim 3, wherein said front plate and said rear plate are of the same darkness.

5. The gas discharge display panel according to claim 3, wherein said front plate and said rear plate are of different darknesses.

6. The gas discharge display panel according to claim 3, wherein said front plate and said rear plate are each dark in color such that the darkness of each of said front plate and said rear plate is about 30%.

7. The gas discharge display panel according to claim 2, wherein said front plate and said rear plate are of the same darkness.

8. The gas discharge display panel according to claim 2, wherein said front plate and said rear plate are of different darknesses.

9. The gas discharge display panel according to claim 1, wherein said front plate and said rear plate are each dark in color such that the transparency of each of said front plate and said rear plate is about at most 80%.

10. The gas discharge display panel according to claim 9, wherein said front plate and said rear plate are each dark in color such that the transparency of each of said front plate and said rear plate is about at most 80% and at least about 40%.

11. The gas discharge display panel according to claim 10, wherein said front plate and said rear plate are of the same darkness.

12. The gas discharge display panel according to claim 10, wherein said front plate and said rear plate are of different darknesses.

13. The gas discharge display panel according to claim 10, wherein said front plate and said rear plate are each dark in color such that the transparency of each of said front plate and said rear plate is about 70%.

14. The gas discharge display panel according to claim 9, wherein said front plate and said rear plate are of the same darkness.

15. The gas discharge display panel according to claim 9, wherein said front plate and said rear plate are of different darknesses.

* * * * *